United States Patent [19]

Mohn

[11] Patent Number: 5,035,842

[45] Date of Patent: Jul. 30, 1991

[54] FLUID MIXING OR HOMOGENIZATION

[75] Inventor: Frank Mohn, London, England

[73] Assignee: Framo Developments (UK) Limited, London, England

[21] Appl. No.: 465,955

[22] Filed: Jan. 16, 1990

[30] Foreign Application Priority Data

Jan. 16, 1989 [GB] United Kingdom ..... 8900841

[51] Int. Cl.[5] ..... B01F 3/04

[52] U.S. Cl. ..... 261/76; 261/DIG. 75; 366/101

[58] Field of Search ..... 261/DIG. 75, 76; 366/101, 107

[56] References Cited

U.S. PATENT DOCUMENTS

| | | | |
|---|---|---|---|
| 543,410 | 7/1895 | Taylor | 261/DIG. 75 |
| 3,371,618 | 3/1968 | Chambers | 261/DIG. 75 |
| 3,960,175 | 6/1976 | Liepe et al. | 261/DIG. 75 |
| 4,017,565 | 4/1977 | Muller | 261/DIG. 75 |
| 4,051,204 | 9/1977 | Muller et al. | 366/101 |
| 4,086,306 | 4/1978 | Yoshinaga | 261/DIG. 75 |
| 4,168,705 | 9/1979 | Raab | 261/DIG. 75 |
| 4,267,052 | 5/1981 | Chang | 261/DIG. 75 |

FOREIGN PATENT DOCUMENTS

| | | | |
|---|---|---|---|
| 96928 | 3/1924 | Austria | 261/DIG. 75 |
| 2355554 | 1/1978 | France | 261/DIG. 75 |

*Primary Examiner*—Tim Miles

*Attorney, Agent, or Firm*—Young & Thompson

[57] ABSTRACT

A non-homogenous mixture of liquid and gas is fed into a vessel to form a body of gas above a pool of liquid. Liquid is fed from the pool through a discharge pipe containing a constriction forming a venturi and gas is drawn from the gas body through a pipe extending through the liquid pool into the discharge pipe to effect mixing of the liquid and the gas in the venturi. Perforations in the discharge pipe adjust the amounts of gas and liquid leaving the vessel to maintain both liquid and gas within the vessel.

17 Claims, 1 Drawing Sheet

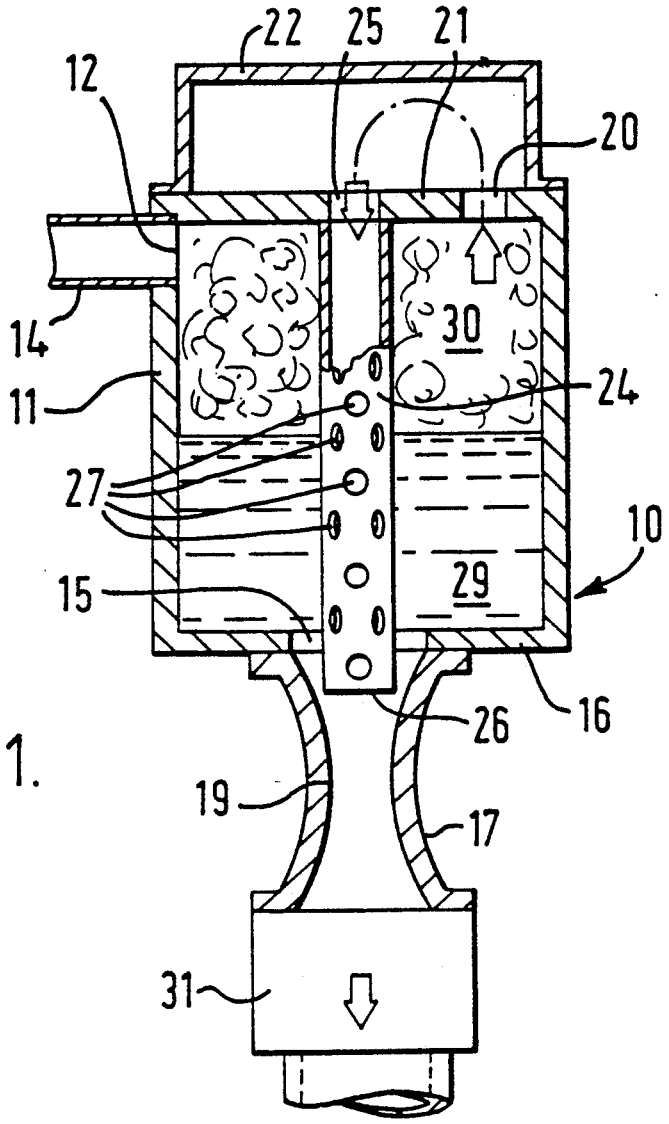
FIG.1.
FIG.2.
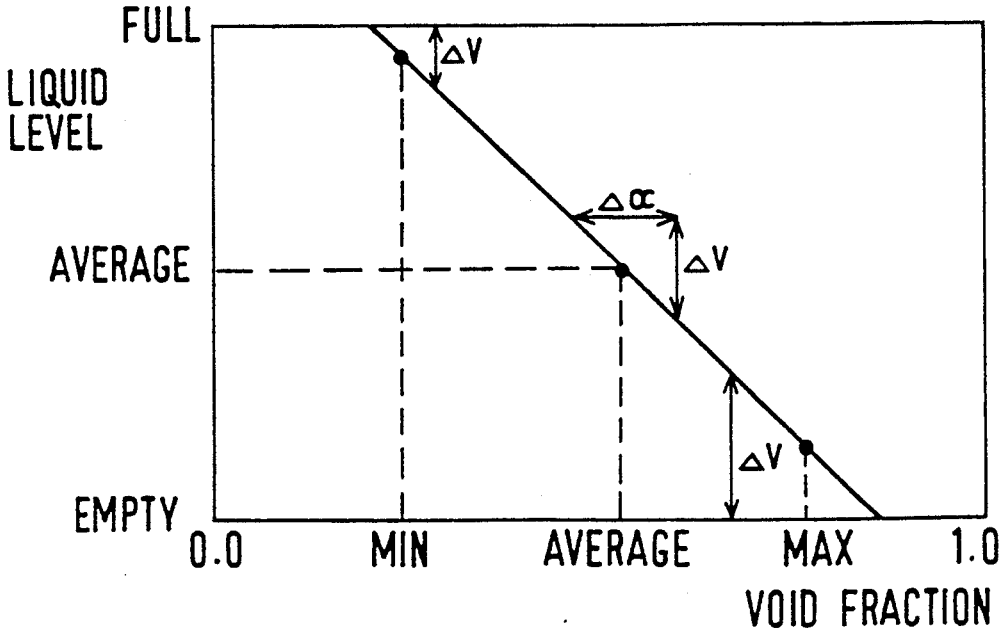

FLUID MIXING OR HOMOGENIZATION

FIELD OF THE INVENTION

The invention relates to the homogenization or mixing of fluids.

BACKGROUND OF THE INVENTION

The invention has particular application to the treatment of fluid flows which are multi-phase, in that they comprise both gas and liquid components, but which are by no means uniformly better mixed or homogenized. A mixture of gas and oil extracted from an onshore or a subsea well, for example, can vary substantially as regards its gas and liquid components. It may comprise slugs of substantially unmixed liquid separated by primarily gaseous portions, as well as portions that are more or less homogeneous. This inconsistency of the nature of the extracted material makes it difficult to handle, in particular by pumping equipment, which could more readily deal with a more homogeneous mixture.

It is accordingly an object of the invention to provide a method and an apparatus for continuously mixing together liquid and gaseous fluid flows without a mixing drive input.

It is also an object of the invention to provide means which can be inserted in a flow of highly nonhomogenous multi-phase fluid to effect mixing of the fluid phases without mechanical input.

It is a further object of the invention to provide an apparatus for organization of a non-homogenous mixed phase fluid flow facilitating mixture of the phases in a venturi.

SUMMARY OF THE INVENTION

The invention provides for the formation of a liquid pool and a body of gas, as by feeding a multiphase fluid into a tank or container, and for the withdrawal of the liquid from the pool and of the gas from the body for admixture in a venturi. The liquid flow in a discharge duct or outlet pipe containing the venturi creates suction by which the gas is drawn into the liquid flow, as through a pipe having an inlet end communicating with the upper region of the tank and an outlet end within the discharge duct at or just upstream of the venturi. The liquid flow in the discharge pipe can be induced by gravity, the tank outlet to the discharge pipe being then conveniently located in the floor of the tank. The liquid flow can instead be pump-induced or aided and the venturi can then be located directly upstream of a pump unit.

The gas component can be drawn from the gas body through an aperture in the roof of the tank which communicates with the gas supply pipe by a transverse extension thereof outside the tank or by way of a chamber mounted on the tank roof. Alternatively such a supply chamber can be separated from the main volume of the tank by a suitably apertured internal partition.

Preferably, the apparatus incorporates means tending to ensure that the tank or container always contains some of both the liquid and the gas components. The invention can accordingly provide that the supply pipe conveying the gas to the venturi extends through the pool of liquid in the tank and is provided with apertures or perforations spaced apart along it. Some of the liquid thus flows together with the gas in the supply pipe to the venturi. The amount or proportion of the gas component which is drawn off from above the liquid thus decreases as a function of an increase of the liquid level, as more of the perforations are submerged. Integral regulation is thus conveniently obtained.

The invention will thus be understood to provide a simple and effective mixing or homogenizing method and apparatus, which can operate under gravity in appropriate conditions, without the need for a power input, and which can incorporate automatically operating regulator means.

BRIEF DESCRIPTION OF THE DRAWINGS

The invention is further described below, by way of example, with reference to the accompanying drawings, in which:

FIG. 1 is a schematic sectional view of a mixing or homogenising unit or apparatus embodying the invention; and FIG. 2 graphically illustrates the relationship between the liquid level in the apparatus of FIG. 1 and the void fraction drawn off.

DETAILED DESCRIPTION

The mixing unit or apparatus of FIG. 1 comprises a vessel or container 10 of generally upright cylindrical form of which the interior is closed, except for the fluid inlets and the outlets to be described. At the upper region of the cylindrical side wall 11 of the container, there is provided an inlet port 12 communicating by a pipe 14 with a source (not shown) of a multiphase fluid. A liquid outlet port 15 is provided centrally in the floor 16 of the container 10 and communicates with an outlet or discharge pipe or fitting 17 having an internal constriction 19 which forms a venturi. A gas outlet port 20 in the roof 21 of the container communicates with an upper chamber 22 mounted on the roof. Also communicating with the chamber 22 is a generally vertical pipe 24 extending downwardly from a central aperture 25 in the roof. The pipe 24 extends downwardly through the container interior into the discharge fitting 17, the lower open end 26 of the pipe being located concentrically within the fitting just above the constriction 19 forming the venturi.

The upper portion of the container 10 thus communicates with the pipe 24 by way of the chamber 22 and for a reason explained below, this upper container portion also communicates with the pipe 24 through a series of perforations 27 through the pipe wall. The perforations 27 extend along substantially the entire length of the pipe 24 within the container.

The liquid component of a multi-phase fluid flow entering the container by way of the inlet port 12 tends to separate under gravity from the gaseous component and forms a pool 29 in the lower part of the container. A body of the gaseous component occupies the upper part of the container, above the free surface of the liquid pool.

The liquid component is withdrawn from the pool 29 in the container through the discharge port 15 under gravity, with or without the assistance of a downstream pump 31 connected for example at the lower end of the discharge pipe 27, as schematically shown, and the effect of the venturi is to draw the gas from the upper part of the tank interior through the pipe 24 in admixture with the liquid phase, so that a homogenized or substantially homogenized fluid is obtained in the discharge pipe 17. If the multi-phase fluid flow entering the container interior is already homogenous or approximately so, then the mixture will be discharge through the pipe 27 by way of both the outlet port 15 and the open end 26.

The void fraction $\alpha$ of the fluid discharged from the container 10 depends on the dimensions of the venturi, and can be made independent of the total flow rate $Q^T$, the liquid level h in the container, and the absolute pressure $\rho$.

Assuming that both some liquid and some gas are present in the container, the total pressure drop for the gas and for the liquid phases flowing through it will be equal, and the void fraction from the container can be obtained from the resulting equation as follows:

$$\frac{\rho_L}{2}(1-\alpha)^2 \cdot Q_T^2\left[\frac{(1+\xi_L)}{A_L^2} - \frac{1}{A_T^2} - \frac{2 \cdot g \cdot h}{(1-\alpha)^2 \cdot Q_T^2}\right] = \frac{\rho_G}{2}\alpha^2 \cdot Q_T^2\left[\frac{(1+\xi_G)}{A_G^2} - \frac{1}{A_T^2}\right]$$

where:

$A_T$—the cross-sectional area of the container, $A_L$—the cross-sectional area of the liquid in the venturi, $A_G$—the cross-sectional area of the gas in the venturi, $\nu_L$—the total liquid loss coefficient, $\nu_G$—the total gas loss coefficient, $\rho_L$—the liquid density, $\rho_G$—the gas density, and g—gravity.

During steady flow conditions, the average void fraction drawn from the container will equal the average void fraction entering it. To ensure that both liquid and gas are always present in the container, it is convenient to decrease the gas fraction drawn off as the liquid level increases, and vice versa, and this is achieved by the perforations 27 in the pipe 24. The perforated pipe 24 thus acts as an integral regulator allowing a variation in the void fraction.

The relation between the liquid level in the container and the void fraction drawn from it (the mixing unit characteristic) is illustrated in FIG. 2. Any desired mixing unit characteristic can be obtained by appropriate choice of dimensions of the venturi and the perforations 27 in the pipe portion 24.

It is evident that those skilled in the art may make numerous modifications of the specific embodiment described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

I claim:

1. An apparatus for receiving a multi-phase fluid from a source thereof and for homogenizing said multiphase fluid, said apparatus comprising:

a vessel, inlet piping communicating between said source and an upper region of said vessel to form within said vessel a pool of liquid phase fluid from said source beneath a body of gaseous phase fluid from said source, outlet piping extending from said vessel for discharging therefrom liquid phase fluid from said pool, a constriction in said outlet piping forming a venturi, and tubing communicating between said body of gaseous phase fluid and said outlet piping for mixing in said venturi gaseous phase fluid from said body thereof with liquid phase fluid discharging from said pool thereof through said outlet piping.

2. The apparatus of claim 1, wherein said tubing extends with said vessel through said pool and into said outlet piping and has aperture means in said tubing for admission therein of said liquid phase from said pool.

3. An apparatus for improving the mixing of a mixture of a liquid and a gas, said apparatus comprising:

a vessel, a common inlet to said vessel for said mixture, said vessel being adapted to receive therewithin a pool of said liquid beneath a body of said gas, a discharge pipe extending from said vessel for discharging therefrom liquid from said pool thereof, said vessel being closed apart from said common inlet and said discharge pipe, a constriction in said discharge pipe forming a venturi, and piping communication between said gas body and said discharge pipe for mixing in said venturi gas from said body thereof with liquid discharging from said pool thereof through said discharge pipe.

4. A mixer apparatus comprising:

a vessel for receiving therein liquid and a gas above the liquid, an outlet duct leading from the lower part of said vessel, a venturi in said outlet duct, pipe means having an inlet end located at the upper part of said vessel and extending through said liquid to an outlet end located within said outlet duct in the region of said venturi, whereby passage of liquid outwardly of said vessel through said outlet duct and said venturi therein draws gas from the upper part of said vessel for admixture thereof with said liquid, and aperture means in said pipe means at least partly within said liquid permitting an amount of said liquid dependent on the amount thereof within the vessel to flow with said gas in said pipe means.

5. The mixer apparatus of claim 4 wherein said vessel has a common inlet for said liquid and said gas.

6. The mixer apparatus of claim 4 further comprising the pump having a suction inlet communicating with said outlet duct downstream of said venturi.

7. An apparatus for mixing together a liquid and a gas comprising:

a container for receiving therein said liquid and said gas, a discharge duct for receiving a flow of said liquid from said container, a venturi formed in said discharge duct, and supply means supplying said liquid and said gas from said container to said discharge duct for mixing in said venturi in amounts adjusted to maintain both said liquid and said gas present in said container, said supply means comprising pipe means having inlet means communicating with said gas within said container, outlet means within said discharge duct, said pipe means extending through said liquid to said outlet means, and perforations spaced along said pipe means within said liquid and said gas for entry thereto of quantities of said liquid and said gas dependent on the depth of said liquid in said container.

8. A homogenizing apparatus comprising:

a vessel, said vessel having a roof, first and second apertures in said roof, side wall means, and a floor, an inlet at the upper region of said vessel for admission into said vessel of fluid material having a liquid component and a gaseous components, said liquid component forming a liquid pool in the lower part of said vessel with a body of said gaseous component in the upper part thereof, a discharge duct extending from said lower part of said vessel for receiving a discharge flow of liquid from said liquid pool, a constriction in said discharge duct forming a venturi therein, and a pipe extending from an inlet end communicating with said upper part of said vessel to a discharge end within said discharge duct upstream of said venturi, for supply of said gaseous component from said body into said liquid component discharge flow to effect mixing of said liquid and gaseous components, wherein said inlet is located in said side wall means adjacent said roof, said outlet duct communicates with said vessel through said floor, and wherein said pipe extends upwardly through said first roof aperture to communicate with said vessel by way of said second roof aperture.

9. A homogenizing apparatus comprising:

a vessel, an inlet at the upper region of said vessel for admission into said vessel of fluid material having a liquid component and a gaseous components, said liquid component forming a liquid pool in the lower part of said vessel and said gaseous component forming a body in the upper part of said vessel, a discharge duct extending from said lower part of said vessel for receiving a discharge flow of liquid from said liquid pool, a constriction in said discharge duct forming a venturi therein, and a pipe extending from an inlet end communicating with said body of gaseous component in said upper part of said vessel to a discharge end within said discharge duct upstream of said venturi, for supply of said gaseous component from said body into said liquid component discharge flow to effect mixing of said liquid and gaseous components, said pipe comprising perforations spaced therealong at least partly within said liquid pool.

10. The apparatus of claim 9 further comprising pump means connected in said discharge duct downstream of said venturi.

11. The apparatus of claim 9 wherein said vessel has a roof, first and second apertures in said roof, side wall means, and a floor, and wherein said inlet is located in said side wall means adjacent said roof, said outlet duct communicates with said vessel through said floor, and wherein said pipe extends upwardly through said first roof aperture to communicate with said vessel by way of said second roof aperture.

12. A mixer apparatus comprising:

a vessel for receiving therein liquid and a gas above the liquid, an outlet duct leading from the lower part of said vessel, a venturi in said outlet duct, pipe means having an inlet end located at the upper part of said vessel and communicating with the exterior of said vessel, said pipe means having an outlet end located within said outlet duct in the region of said venturi, gas supply passage means communicating between said inlet end and an aperture in the upper region of said vessel, whereby passage of liquid outwardly of said vessel through said outlet duct and said venturi therein draws gas from the upper part of said vessel through said aperture and into said inlet end for admixture with said liquid.

13. The mixer apparatus of claim 12, further comprising a pump having a suction inlet communicating with said outlet duct downstream of said venturi.

14. The mixer apparatus of claim 12, wherein said vessel has a common inlet for said liquid and said gas.

15. The mixer apparatus of claim 12, further comprising means for adjusting the amounts of said liquid and said gas leaving said vessel so as to maintain both liquid and gas within said vessel.

16. The mixer apparatus of claim 12, wherein said pipe means extends to said outlet end through said liquid, and further comprising aperture means in said pipe means in said liquid permitting an amount of said liquid dependent on the amount thereof within the vessel to flow with said gas in said pipe means.

17. An apparatus for mixing together of a liquid and a gas, said apparatus comprising:

a vessel adapted to receive therewithin a pool of said liquid beneath a body of said gas, a discharge pipe extending from said vessel for discharging from said vessel liquid from said pool thereof, a constriction in said discharge pipe forming a venturi, piping communicating between said gas body and said discharge pipe for mixing in said venturi gas from said body thereof with liquid discharging from said pool thereof through said discharge pipe, and aperture means in said piping communicating between said liquid pool and the interior of said piping.

* * * * *

UNITED STATES PATENT AND TRADEMARK OFFICE

CERTIFICATE OF CORRECTION

PATENT NO. : 5,035,842

DATED : July 30, 1991

INVENTOR(S) : Frank MOHN

It is certified that error appears in the above—identified patent and that said Letters Patent is hereby corrected as shown below:

Column 4, line 26, (claim 3), change "communication" to --communicating--.

Signed and Sealed this

Twenty-eighth Day of September, 1993

Bruce Lehman

*Attest:*

BRUCE LEHMAN

*Attesting Officer*

*Commissioner of Patents and Trademarks*